US010703010B2

(12) United States Patent
Chung

(10) Patent No.: US 10,703,010 B2
(45) Date of Patent: Jul. 7, 2020

(54) METHOD FOR MAKING MODULAR ARMREST

(71) Applicant: FU JIAN QUANYU INDUSTRY CO., LTD., Fujian (CN)

(72) Inventor: Min-Ju Chung, Taichung (TW)

(73) Assignee: FU JIAN QUANYU INDUSTRY CO., LTD., Zhangzhou, Fujian (CN)

( * ) Notice: Subject to any disclaimer, the term of this patent is extended or adjusted under 35 U.S.C. 154(b) by 225 days.

(21) Appl. No.: 16/006,353

(22) Filed: Jun. 12, 2018

(65) Prior Publication Data

US 2019/0248040 A1 Aug. 15, 2019

(30) Foreign Application Priority Data

Feb. 13, 2018 (CN) ..... 2018 2 0258127 U

(51) Int. Cl.

| | |
|---|---|
| ***B27M 3/00*** | (2006.01) |
| ***B27M 3/18*** | (2006.01) |
| ***A47C 7/54*** | (2006.01) |

(52) U.S. Cl.

CPC ..... *B27M 3/18* (2013.01); *A47C 7/54* (2013.01); *B27M 3/0086* (2013.01)

(58) Field of Classification Search

CPC .... B27M 3/0086; B27M 3/18; B27M 3/0026; B27M 3/0013; B27L 5/08; B27B 1/00; B27B 1/005

USPC ..... 144/350, 355

See application file for complete search history.

(56) References Cited

U.S. PATENT DOCUMENTS

| | | | | |
|---|---|---|---|---|
| 4,050,490 A * | 9/1977 | Werner | B27M 3/0013 | 144/350 |
| 8,123,299 B2 * | 2/2012 | Lin | A47C 7/54 | 144/347 |
| 2018/0154547 A1 * | 6/2018 | Hirmke | B27M 3/006 | |

* cited by examiner

*Primary Examiner* — Matthew Katcoff

(57) ABSTRACT

A method for making modular armrest includes the steps of providing at least fourteen blank wood pieces, arranging the blank wood pieces in juxtaposed relationship, bonding the arranged blank wood pieces to obtain a bonded blank assembly, and marking four sawlines to divide a front surface of the bonded blank assembly into five trapezoid zones, the middle tree of which has the same surface area. Among the three middle trapezoid zones, the inbetween is an inverted form of each of the flank ones such that the inbetween corresponds to a widthwise profile of the modular armrest while each of the flank ones corresponds to an inverted form of the widthwise profile.

8 Claims, 8 Drawing Sheets

METHOD FOR MAKING MODULAR ARMREST

CROSS-REFERENCE TO RELATED APPLICATION

This application claims priority from Chinese utility model patent application no. 201820258127.7, filed on Feb. 13, 2018.

FIELD

The disclosure relates to a method for making a modular armrest, more particularly to a method for making a modular armrest using blank wood pieces each having a predetermined dimension.

BACKGROUND

As shown in FIGS. 1 and 2, in a conventional method for making a modular armrest 200, three wood sheets 2', each having a height (H), are bonded to form a wood laminate 2", and the wood laminate 2" is then sawed in a direction normal to the wood laminate 2" to obtain a plurality of wood segments 20 each of which is constituted by three blank wood pieces 11 extending in a longitudinal direction, and each of which has a cross-section corresponding to a widthwise profile 201 of the modular armrest 200. Finally, each of the wood segments 20 is processed using a lathe or the like to obtain the modular armrest 200.

In such modular manufacturing process, each of the blank wood pieces 11 has a width (W) substantially the same as a maximum width ($W_{max}$) defined by the widthwise profile 201, and the height (H) of each blank wood piece 11 is substantially equal to one-third of a maximum height ($H_{max}$) defined by the widthwise profile 201.

SUMMARY

An object of the disclosure is to provide a novel method for making a modular armrest in a wood-saving manner.

According to a first aspect of the disclosure, a method for making a modular armrest is provided. The modular armrest extends in a longitudinal direction, and has a widthwise profile that defines a maximum height ($H_{max}$) and that has a lower region defining a lower maximum width ($W_{low}$) and an upper region defining a maximum width ($W_{max}$). The modular armrest satisfies an equation of $W_{max}>W_{low}$. The method includes the steps of:

(i) providing a bonded blank assembly which has a front surface, and which includes a plurality of juxtaposed blank wood pieces each extending in the longitudinal direction, and each having a height (H) and a width (W), each of the blank wood pieces satisfying equations of $W \approx W_{max}$ and $W>H$; and (ii) marking at least three sawlines for sawing in the longitudinal direction, two adjacent ones of the sawlines being inclined in opposite directions to divide the front surface into a plurality trapezoid zones, which have the same surface area, such that one of the trapezoid zones corresponds to the widthwise profile while each of two flank ones of the trapezoid zones corresponds to an inverted form of the widthwise profile.

According to a second aspect of the disclosure, a method for making a modular armrest is provided. The modular armrest extends in a longitudinal direction, and has a widthwise profile that defines a maximum height ($H_{max}$) and that has a lower region defining a minimum width ($W_{min}$) and an upper region defining a maximum width ($W_{max}$). The modular armrest satisfies an equation of $H_{max} \approx W_{max}$. The method includes the steps of:

(a) providing at least fourteen blank wood pieces each of which extends in the longitudinal direction, and each of which has a height (H) and a width (W), each of the blank wood pieces satisfying equations of $W \approx W_{max}$ and $H \approx 1/3 H_{max}$;

(b) arranging the blank wood pieces in juxtaposed relationship in a transverse direction relative to the longitudinal direction;

(c) bonding the arranged blank wood pieces to obtain a bonded blank assembly which has a front surface and which has a combined profile that has a total width ($W_{total}$) and a total height ($H_{total}$), and that satisfies equations of $W_{total}=14$ H and $H_{total}=W$; and (d) marking four sawlines for sawing in the longitudinal direction to divide the front surface into five trapezoid zones, the middle three of which have the same surface area, and among the middle three, the inbetween being an inverted form of each of the flank ones such that the inbetween corresponds to the widthwise profile while each of the flank ones corresponds to an inverted form of the widthwise profile.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
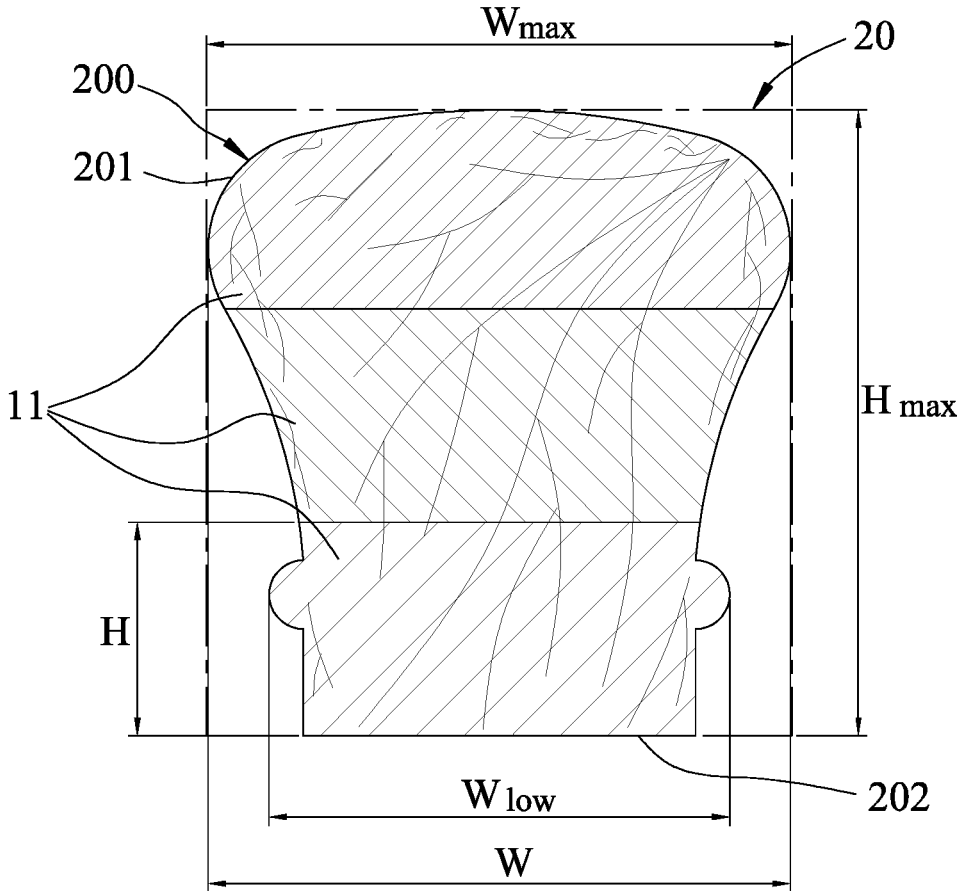
FIG.1 PRIOR ART
FIG. 1 is a cross-sectional view of a modular armrest made by a conventional method.
Figure 2:
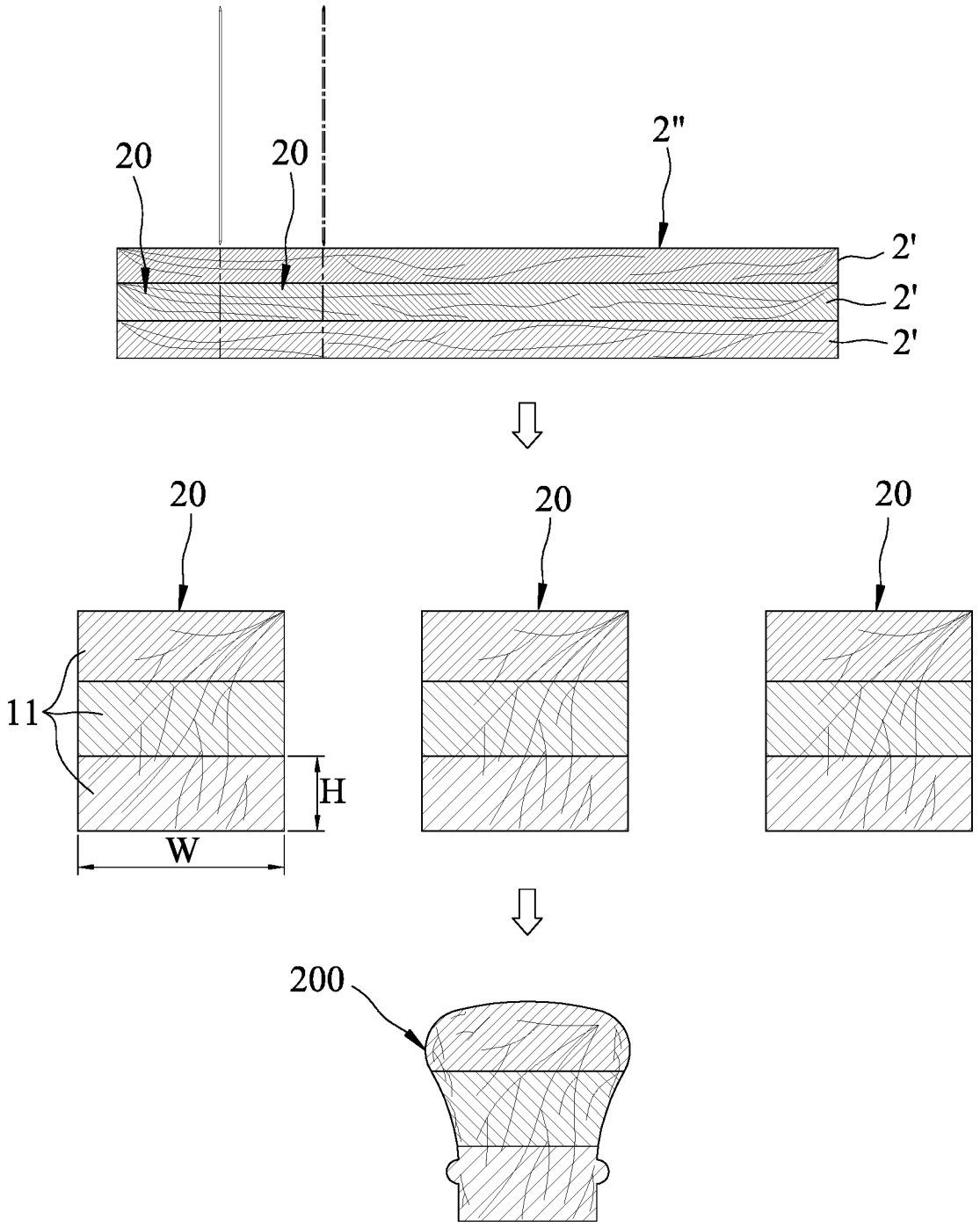
FIG.2 PRIOR ART
FIG. 2 is a flow chart showing the conventional method for making the modular armrest.

Before the disclosure is described in greater detail, it should be noted that where considered appropriate, reference numerals have been repeated among the figures to indicate corresponding or analogous elements, which may optionally have similar characteristics.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 3:
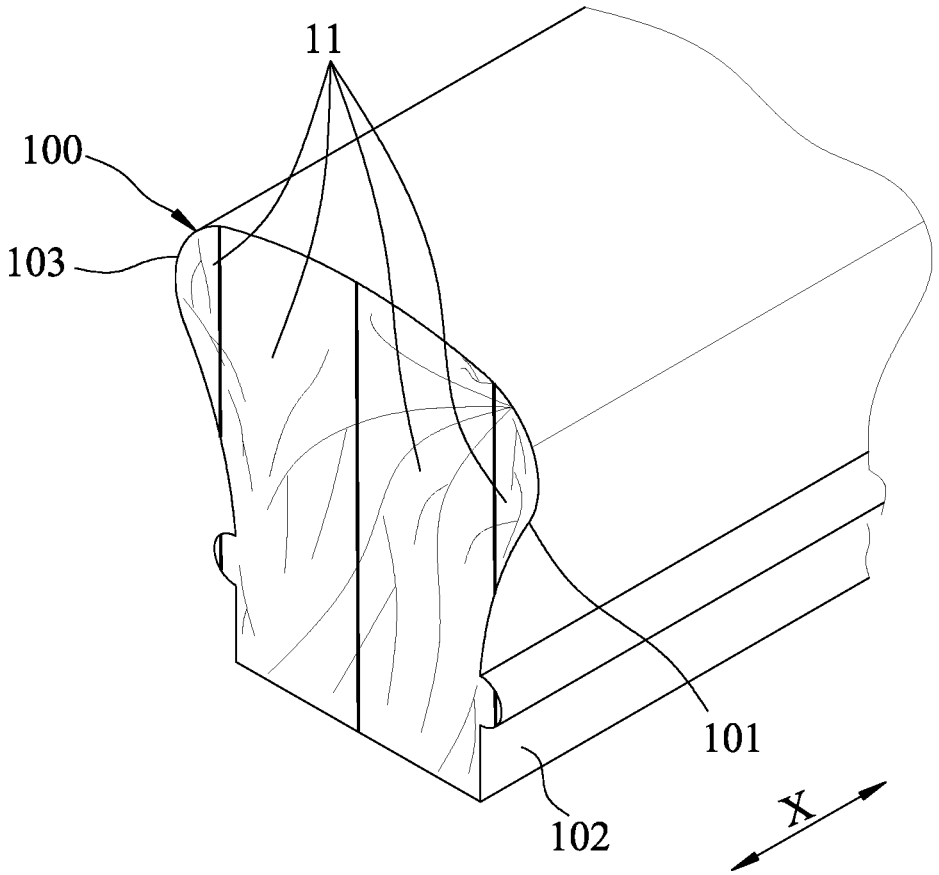
FIG. 3 is a perspective view of a modular armrest made by a method according to a first embodiment of the disclosure.
Figure 4:
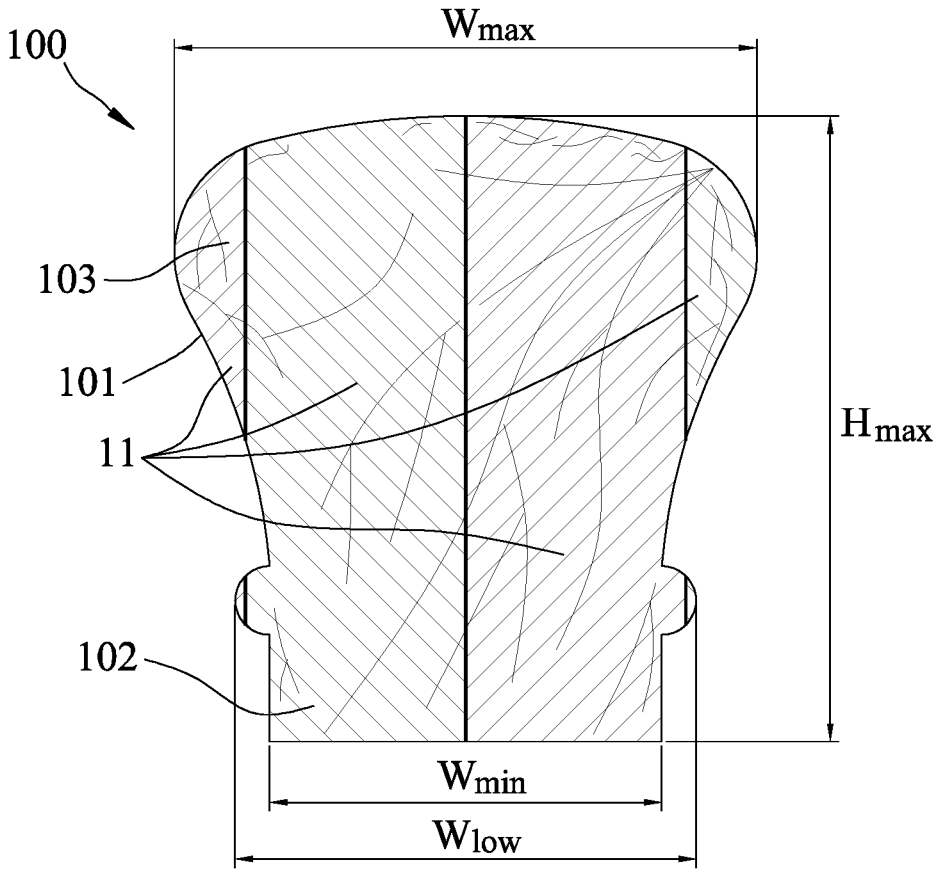
FIG. 4 is a cross-sectional view of the modular armrest of FIG. 3.
Figure 5:
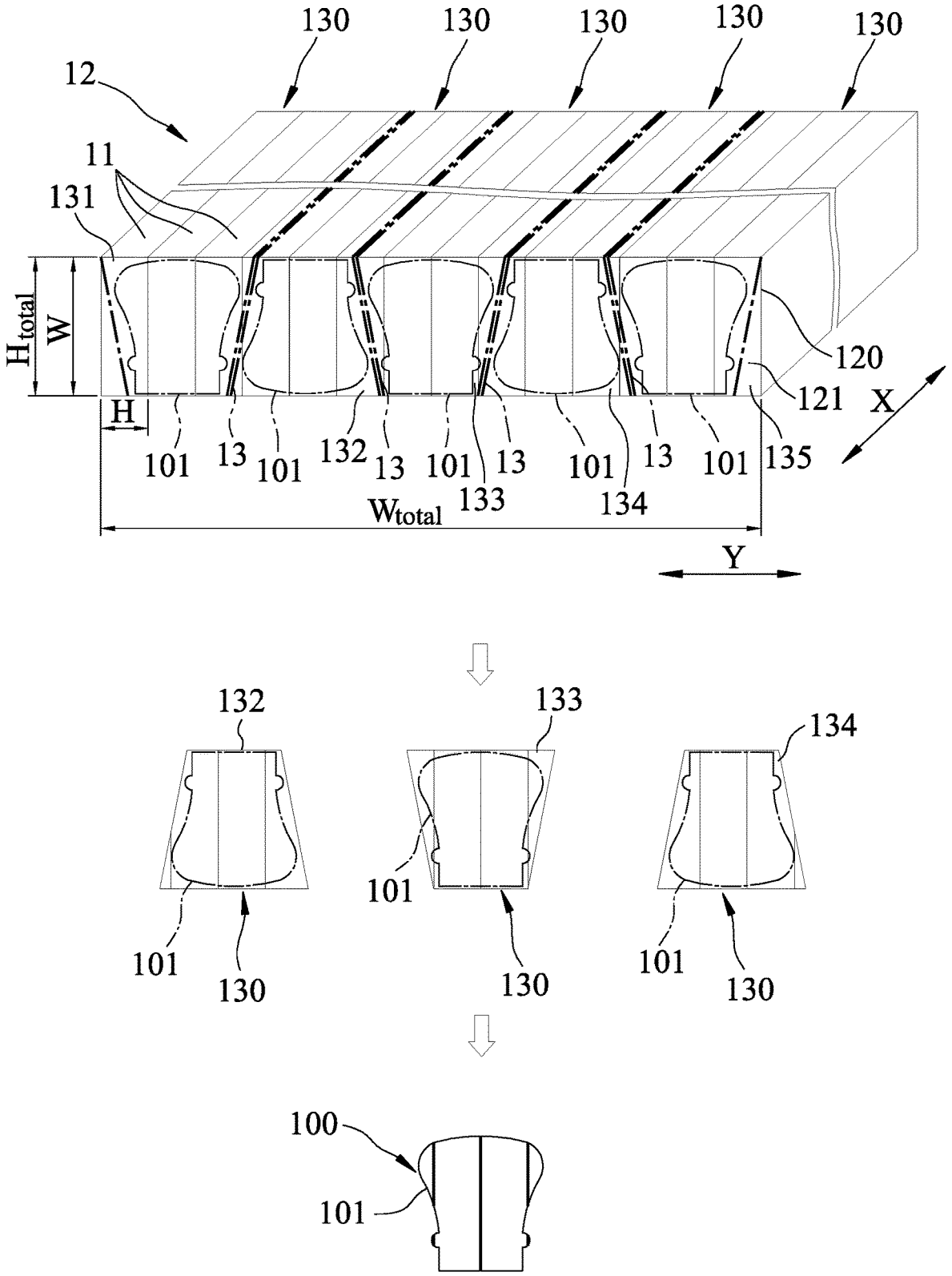
FIG. 5 is a flow chart showing the method of the first embodiment.

A modular armrest 100 shown in FIGS. 3 and 4 has a widthwise profile 101 similar to the widthwise profile 201 of the conventional modular armrest 200, but is made by a method according to a first embodiment of the disclosure as shown in FIG. 5. The widthwise profile 101 defines a maximum height ($H_{max}$), and has a lower region 102 defining a minimum width ($W_{min}$) and a lower maximum width ($W_{low}$), and an upper region 103 defining a maximum width ($W_{max}$). In addition, the modular armrest 100 satisfies equations of $H_{max} \approx W_{max}$, $W_{max} > W_{low}$, and $14/3H_{max} \approx 3W_{max} + 2W_{min}$.

The method for making the modular armrest 100 includes steps (a) to (e).

In step (a), as shown in FIG. 5, at least fourteen blank wood pieces 11 are provided. Each of the blank wood pieces 11 extends in the longitudinal direction (X), and has a height (H) and a width (W) (see FIGS. 1 and 5). Each of the blank wood pieces 11 satisfies equations of $W \approx W_{max}$ and $H \approx 1/3H_{max}$. In this embodiment, each of the blank wood pieces 11 is a signal wood piece.

In step (b), the blank wood pieces 11 are arranged in juxtaposed relationship in a transverse direction (Y) relative to the longitudinal direction (X).

In step (c), the arranged blank wood pieces 11 are bonded to obtain a bonded blank assembly 12 which has a front surface 121 and which has a combined profile 120 that has a total width ($W_{total}$) and a total height ($H_{total}$) and that satisfies equations of $W_{total}$=14 H and $H_{total}$=W.

In step (d), four sawlines 13 are marked for sawing in the longitudinal direction (X) to divide the front surface 121 into five trapezoid zones 131, 132, 133, 134, 135. The three middle trapezoid zones 132, 133, 134 have the same surface area. Among the three middle trapezoid zones 132, 133, 134, the inbetween 133 is an inverted form of each of the flank ones 132, 134 such that the inbetween 133 corresponds to the widthwise profile 101 while each of the flank ones 132, 134 corresponds to an inverted form of the widthwise profile 101.

As shown in FIG. 5, in step (d), the bonded blank assembly 12 is sawed into five segments 130.

In step (e), each of the five segments 130 is trimmed using a lathe or the like to obtain the modular armrest 100.

Figure 6:
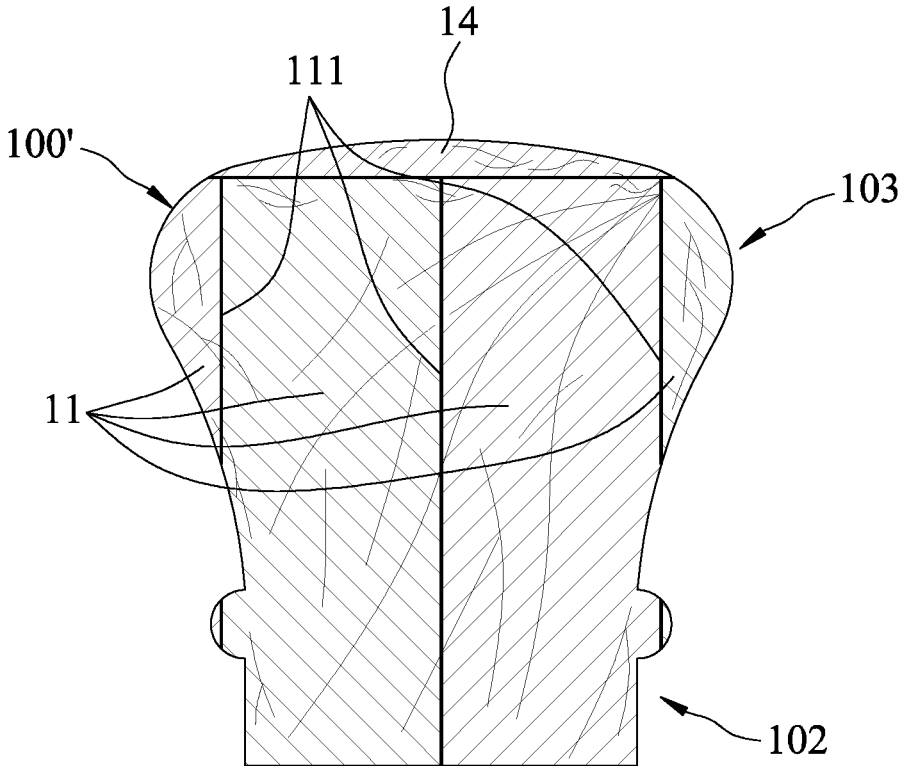
FIG. 6 is a cross-sectional view of a modular armrest made by a method according to a second embodiment of the disclosure.
Figure 7:
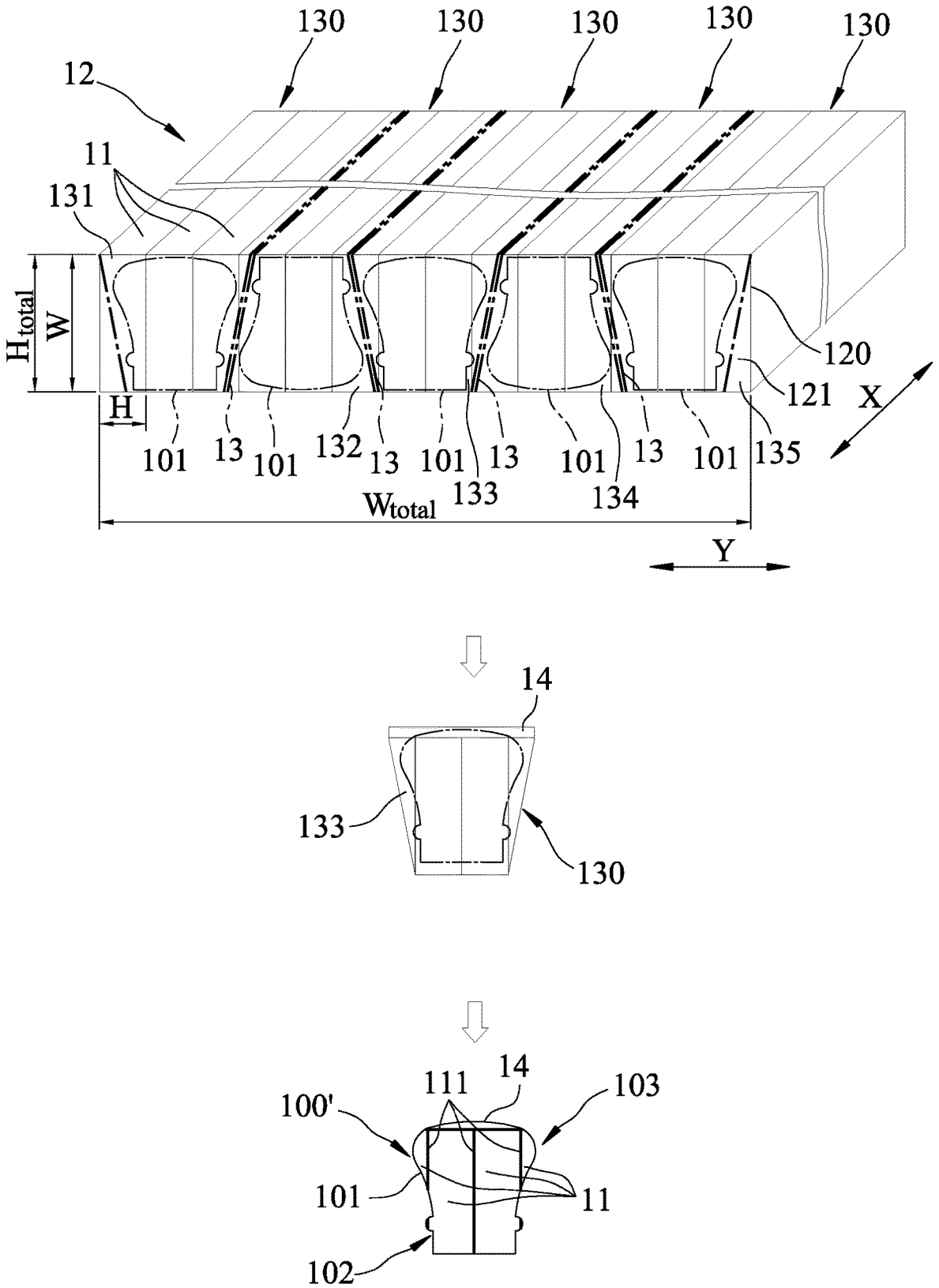
FIG. 7 is a flow chart showing the method of the second embodiment.

FIG. 6 illustrates a modular armrest 100' which is made by a method according to a second embodiment of the disclosure as shown in FIG. 7. The second embodiment is similar to the first embodiment, except that the method of the second embodiment further includes, between steps (d) and (e), a step of adhering a wood skin layer 14 onto each of the five segments 130 so as to conceal bonding lines 111 among the blank wood pieces 11 in the upper region 103 of the modular armrest 100'.

Figure 8:
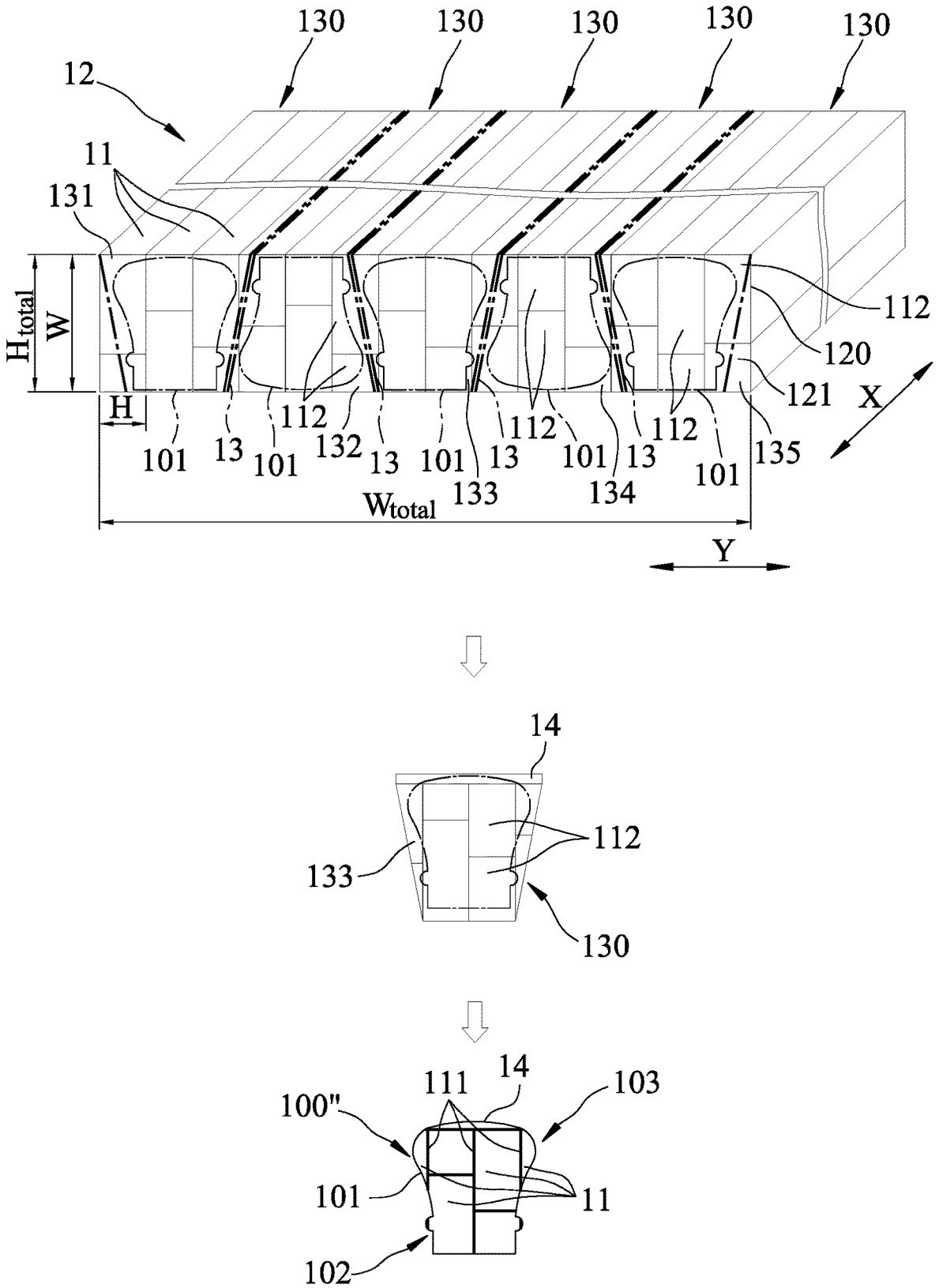
FIG. 8 is a flow chart showing a modified method of the second embodiment.

FIG. 8 illustrates a modified method of the second embodiment for making a modular armrest 100". In the modified method, at least one of the blank wood pieces 11 is formed by combining two or more smaller pieces 112.

In the description above, for the purposes of explanation, numerous specific details have been set forth in order to provide a thorough understanding of the embodiment(s). It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A method for making a modular armrest which extends in a longitudinal direction, and which has a widthwise profile that defines a maximum height ($H_{max}$) and that has a lower region defining a lower maximum width ($W_{low}$) and an upper region defining a maximum width ($W_{max}$), the modular armrest satisfying an equation of $W_{max} > W_{low}$, the method comprising the steps of:

(i) providing a bonded blank assembly which has a front surface, and which includes a plurality of juxtaposed blank wood pieces each extending in the longitudinal direction, and each having a height (H) and a width (W), each of the blank wood pieces satisfying equations of $W \approx W_{max}$ and W>H; and (ii) marking at least three sawlines for sawing in the longitudinal direction, two adjacent ones of the sawlines being inclined in opposite directions to divide the front surface into a plurality trapezoid zones, which have the same surface area, such that one of the trapezoid zones corresponds to the widthwise profile while each of two flank ones of the trapezoid zones corresponds to an inverted form of the widthwise profile.

2. The method according to claim 1, wherein step (i) includes the substeps of:

(a) providing the blank wood pieces;

(b) arranging the blank wood pieces in juxtaposed relationship in a transverse direction relative to the longitudinal direction; and (c) bonding the arranged blank wood pieces to obtain the bonded blank assembly.

3. The method according to claim 2, wherein in step (a), at least fourteen of the blank wood pieces are provided, each of the blank wood pieces further satisfies an equation of $H \approx 1/3H_{max}$, and the bonded blank assembly obtained in step (c) has a combined profile which has a total width ($W_{total}$) and a total height ($H_{total}$), and which satisfies equations of $W_{total}$=14 H and $H_{total}$=W.

4. The method according to claim 1, wherein, in step (ii), the bonded blank assembly is sawed into a plurality of segments, the method further comprising a step (iii) of trimming each of the segments to obtain the modular armrest.

5. The method according to claim 4, further comprising, between steps (ii) and (iii), a step of adhering a wood skin layer onto each of the segments so as to conceal bonding lines among the blank wood pieces in the upper region of the modular armrest.

6. A method for making a modular armrest which extends in a longitudinal direction, and which has a widthwise profile that defines a maximum height ($H_{max}$), and that has a lower region defining a minimum width ($W_{min}$) and an upper region defining a maximum width ($W_{max}$), the modular armrest satisfying an equation of $H_{max} \approx W_{max}$, the method comprising the steps of:

(a) providing at least fourteen blank wood pieces each of which extends in the longitudinal direction, and each of which has a height (H) and a width (W), each of the blank wood pieces satisfying equations of $W \approx W_{max}$ and $H \approx 1/3 H_{max}$;

(b) arranging the blank wood pieces in juxtaposed relationship in a transverse direction relative to the longitudinal direction;

(c) bonding the arranged blank wood pieces to obtain a bonded blank assembly which has a front surface and which has a combined profile that has a total width ($W_{total}$) and a total height ($H_{total}$), and that satisfies equations of $W_{total}=14$ H and $H_{total}=W$; and (d) marking four sawlines for sawing in the longitudinal direction to divide the front surface into five trapezoid zones, the middle three of which have the same surface area, and among the middle three, the inbetween being an inverted form of each of the flank ones such that the inbetween corresponds to the widthwise profile while each of the flank ones corresponds to an inverted form of the widthwise profile.

7. The method according to claim 6, wherein, in step (d), the bonded blank assembly is sawed into five segments, the method further comprising a step (e) of trimming each of the five segments to obtain the modular armrest.

8. The method according to claim 6, further comprising, between steps (d) and (e), a step of adhering a wood skin layer onto each of the five segments so as to conceal bonding lines among the blank wood pieces in the upper region of the modular armrest.

* * * * *